US009646432B2

(12) United States Patent
Madison et al.

(10) Patent No.: US 9,646,432 B2
(45) **Date of Patent: *May 9, 2017**

(54) HAND HELD DATA RETRIEVAL DEVICE WITH FIXED SOLUTION CAPABILITY

(71) Applicant: Innova Electronics, Inc., Irvine, CA (US)

(72) Inventors: Robert Madison, Eastvale, CA (US); Ieon Chen, Laguna Hills, CA (US); Keith Andreasen, Garden Grove, CA (US)

(73) Assignee: INNOVA ELECTRONICS CORPORATION, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/557,651

(22) Filed: Dec. 2, 2014

(65) Prior Publication Data

US 2015/0105972 A1 Apr. 16, 2015

Related U.S. Application Data

(63) Continuation-in-part of application No. 13/567,745, filed on Aug. 6, 2012, now Pat. No. 8,909,416, which (Continued)

(51) Int. Cl.
*G07C 5/08* (2006.01)
*G07C 5/00* (2006.01)

(52) U.S. Cl.
CPC ..... *G07C 5/085* (2013.01); *G07C 5/008* (2013.01); *G07C 5/0808* (2013.01); *G07C 5/0858* (2013.01); *G07C 2205/02* (2013.01)

(58) Field of Classification Search
CPC ..... G07C 5/085; G07C 5/008; G07C 5/0808; G07C 2205/02

(Continued)

(56) References Cited

U.S. PATENT DOCUMENTS

D334,560 S 4/1993 Wilson
5,347,211 A 9/1994 Jakubowski (Continued)

FOREIGN PATENT DOCUMENTS

WO WO 0186576 11/2001

OTHER PUBLICATIONS

Actron, Scan Tools, Autoscanner Plus CP9580, Dec. 21, 2011, www.actron.com/product_detail.php?pid=16364.

*Primary Examiner* — Karen Beck
(74) *Attorney, Agent, or Firm* — Stetina Brunda Garred and Brucker

(57) ABSTRACT

A diagnostic scan tool is provided including a connect/configure module for establishing a communication link between the scan tool and a vehicle electronic control unit (ECU). A vehicle specification module operates to identify a vehicle under test in response to receipt of a vehicle identification number (VIN). A trouble code module retrieves digital trouble codes (DTCs) from the ECU. A freeze frame data module retrieves freeze frame data from the ECU, the retrieved freeze frame data being functionally associated with a highest priority DTC. A database lists possible vehicle defect solutions, indexed to the VIN and the DTCs. A digital signal processor is operative to derive the highest priority DTC from analysis of the retrieved freeze frame data. The digital signal processor further being operative to regulate selection of a most likely vehicle defect solution associated with the VIN and the highest priority DTC.

23 Claims, 6 Drawing Sheets

Related U.S. Application Data is a continuation of application No. 12/082,581, filed on Apr. 14, 2008, now abandoned.

(58) Field of Classification Search
USPC ..... 701/29.1, 29.6, 31.4, 31.5, 31.6, 31.8, 701/33.2, 34.3, 34.4
See application file for complete search history.

(56) References Cited

U.S. PATENT DOCUMENTS

D377,622 S 1/1997 Chen
5,635,841 A 6/1997 Taylor
5,758,300 A 5/1998 Abe
5,767,681 A 6/1998 Huang
5,809,437 A 9/1998 Breed
5,859,628 A 1/1999 Ross et al.
5,884,202 A 3/1999 Arjomand
6,000,413 A 12/1999 Chen
6,055,468 A 4/2000 Kaman et al.
6,094,609 A 7/2000 Arjomand
6,139,120 A * 10/2000 Fukada ..... B60T 8/17554 180/197
6,169,943 B1 1/2001 Simon et al.
6,225,898 B1 5/2001 Kamiya et al.
6,250,077 B1 * 6/2001 Iino ..... F16H 47/04 180/338
6,263,268 B1 7/2001 Nathanson
6,389,337 B1 5/2002 Kolls
6,438,471 B1 8/2002 Katagishi et al.
6,499,385 B2 12/2002 Protti
6,535,112 B1 3/2003 Rothschink
6,587,768 B2 7/2003 Chene et al.
6,611,740 B2 8/2003 Lowrey et al.
6,650,318 B1 11/2003 Arnon
6,718,425 B1 4/2004 Pajakowski et al.
6,732,031 B1 5/2004 Lightner et al.
6,807,469 B2 10/2004 Funkhouser et al.
6,836,708 B2 12/2004 Tripathi
6,847,916 B1 1/2005 Ying
6,868,369 B2 3/2005 Huang
6,925,368 B2 * 8/2005 Funkhouser ..... G07C 5/0808 340/438
6,940,270 B2 9/2005 Chen
D510,287 S 10/2005 Chen
6,957,133 B1 10/2005 Hunt et al.
6,968,733 B2 11/2005 Andreasen
7,030,742 B2 4/2006 Treadway
7,085,680 B2 8/2006 Huang
7,116,216 B2 10/2006 Andreasen
7,209,813 B2 4/2007 Namaky
RE39,619 E 5/2007 Andreasen
D545,223 S 6/2007 Chen
D558,621 S 1/2008 Rich
D559,137 S 1/2008 Protti
D560,129 S 1/2008 Rich
D560,527 S 1/2008 Rich
7,325,775 B2 2/2008 Chen
D563,249 S 3/2008 Chen
7,363,149 B2 4/2008 Klausner et al.
D569,280 S 5/2008 Chen
7,376,497 B2 5/2008 Chen
D571,241 S 6/2008 Andreasen
7,437,227 B2 10/2008 Andreasen
D581,822 S 12/2008 Madison
7,464,000 B2 12/2008 Huang
D590,387 S 4/2009 Chen
7,520,668 B2 4/2009 Chen
RE40,798 E 6/2009 Chen
RE40,799 E 6/2009 Chen
7,603,293 B2 10/2009 Chen
7,620,484 B1 11/2009 Chen
D610,586 S 2/2010 Chen
7,734,390 B2 6/2010 Chen
7,778,750 B2 8/2010 Knight et al.
D624,446 S 9/2010 Chen
D624,838 S 10/2010 Chen
D625,209 S 10/2010 Chen
D625,210 S 10/2010 Chen
D625,634 S 10/2010 Chen
7,904,219 B1 3/2011 Lowrey et al.
7,974,750 B2 7/2011 Namaky
8,019,503 B2 9/2011 Andreasen
8,024,083 B2 9/2011 Chen
D646,188 S 10/2011 Chen
D646,599 S 10/2011 Chen
8,032,419 B2 10/2011 Chen
8,068,951 B2 * 11/2011 Chen ..... G07C 5/008 340/438
8,301,329 B2 10/2012 Andreasen
8,306,687 B2 11/2012 Chen
8,370,018 B2 2/2013 Andreasen et al.
8,509,986 B1 * 8/2013 Chen ..... G06F 3/017 345/168
8,630,765 B2 1/2014 Chen
8,825,271 B2 9/2014 Chen
8,831,814 B2 9/2014 Chen
8,855,621 B2 10/2014 Chen
8,862,117 B2 10/2014 Chen
8,880,274 B2 11/2014 Chen
8,909,416 B2 12/2014 Chen et al.
9,142,066 B2 * 9/2015 Chen ..... G07C 5/008
2002/0007225 A1 * 1/2002 Costello ..... B61K 13/00 700/99
2002/0110146 A1 * 8/2002 Thayer ..... G07C 5/008 370/465
2002/0193925 A1 * 12/2002 Funkhouser ..... G07C 5/0808 701/31.8
2003/0171111 A1 9/2003 Clark
2003/0195681 A1 * 10/2003 Rother ..... G01M 17/007 701/29.6
2004/0110472 A1 6/2004 Witkowski
2004/0154715 A1 * 8/2004 Dufournier ..... B60C 11/24 152/154.2
2005/0035852 A1 * 2/2005 Paulsen ..... G07C 5/085 340/438
2005/0065678 A1 * 3/2005 Smith ..... G07C 5/008 701/31.4
2008/0255721 A1 * 10/2008 Yamada ..... G07C 5/008 701/31.4
2009/0259358 A1 10/2009 Andreasen
2009/0276115 A1 11/2009 Chen
2010/0229044 A1 * 9/2010 Fountain ..... G07C 5/0808 714/37
2010/0256861 A1 * 10/2010 Hodges ..... B60R 16/0234 701/31.4
2011/0144869 A1 * 6/2011 Dix ..... B60W 10/06 701/50
2011/0224866 A1 9/2011 Chen
2011/0264322 A1 10/2011 Chen
2011/0288954 A1 * 11/2011 Bertosa ..... G07C 5/008 705/26.9
2012/0215398 A1 * 8/2012 Chen ..... G06Q 10/20 701/31.6
2013/0317694 A1 * 11/2013 Merg ..... G07C 5/008 701/31.6
2014/0046800 A1 2/2014 Chen
2014/0052328 A1 2/2014 Nguyen
2014/0188331 A1 * 7/2014 Amirpour ..... G07C 5/085 701/31.4
2014/0288761 A1 * 9/2014 Butler ..... G07C 5/0816 701/29.6
2015/0032607 A1 * 1/2015 Chen ..... G07C 5/008 705/39
2015/0088334 A1 * 3/2015 Bowers ..... G06Q 40/08 701/1
2015/0105972 A1 * 4/2015 Madison ..... G07C 5/085 701/33.2
2015/0161893 A1 * 6/2015 Duncan ..... G07C 5/008 701/1

(56) References Cited

U.S. PATENT DOCUMENTS

| | | | | |
|---|---|---|---|---|
| 2015/0170439 | A1* | 6/2015 | Chen | G07C 5/008 701/31.4 |
| 2015/0206357 | A1* | 7/2015 | Chen | G07C 5/008 701/31.4 |
| 2015/0269793 | A1* | 9/2015 | Collins | G07C 5/0808 701/31.4 |

* cited by examiner

HAND HELD DATA RETRIEVAL DEVICE WITH FIXED SOLUTION CAPABILITY

CROSS-REFERENCE TO RELATED APPLICATIONS

This application is a continuation-in-part application of U.S. patent application Ser. No. 13/567,745, filed on Aug. 6, 2012, which is a continuation-in-part of U.S. patent application Ser. No. 12/082,581, filed on Apr. 14, 2008, the contents of which are expressly incorporated herein by reference.

STATEMENT RE: FEDERALLY SPONSORED RESEARCH/DEVELOPMENT

Not Applicable

BACKGROUND

The present invention relates generally to vehicle diagnostic systems and methods, and, more particularly, to diagnostic scan tools operative to access diagnostic information from a vehicle electronic control unit (ECU), and to derive a most likely vehicle solution therefrom.

An On-Board Diagnostic, or OBD, system is a computer-based system that was developed by automobile manufacturers to monitor the performance of various components on an automobile's engine, including emission controls. Modern vehicles typically have a vehicle diagnostic system, including one or more modules. Examples of such computer control modules (also known as just "modules") are: a power train control module (PCM), an engine control module (ECM), a transmission control module (TCM), an ABS control module and an air bag control module. Upon detection of any malfunction, the OBD system provides the owner of the automobile with an early warning indicator (such as illuminating the check engine light in the dashboard of automobile).

Contemporary ECU's are operative to monitor the operating conditions of various onboard systems and electrical devices to identify and report any defective conditions. Such ECU's have become increasingly sophisticated in their ability to store data related to various defects and to communicate such information to diagnostic tools in communication with the ECU.

OBD was primarily introduced to meet EPA emission standards but through the years, OBD systems have become more sophisticated. For example, in the mid 1990's OBD-2, Standard Edition was implemented in light-duty cars and trucks. OBD-2 provides a plurality of sensors to monitor malfunctions in the engine, chassis, body, and accessory devices. In a simple scenario, the OBD system detects a malfunction in the engine (or any other component that is monitored by sensors of the OBD system) and signals a warning indicative of such a malfunction. For example, a check engine light could be illuminated in an automobile's dashboard indicative of such malfunction. The automobile's owner, upon noticing such a warning indicator, can make plans for taking the automobile to a service station where the malfunction can be further investigated.

Upon arrival at the service station, a repair personnel can connect a cable that serves as a communications link between the automobile's diagnostic port and computing device (such as a code reader, scan tool, or laptop). Once connected, the computing device decodes OBD-2 system signals (such as diagnostic trouble codes [DTC] received via the diagnostic port), and presents them to the service station personnel who can then make a decision respecting how to fix the malfunction.

Off-board devices, such as portable code reader/scan tools have been marketed for retrieving and interpreting vehicle diagnostic data. Code readers are generally more simple devices which typically only retrieve and display the problem diagnostic codes. Scan tools can also retrieve and display problematic diagnostic codes, but include additional functionality as well, such as retrieving live data and performing live tests on automobile systems. Some handheld test devices have added circuits for testing systems such the charging system and scanning circuitry wherein live data can be requested for and received.

Scan tools and code readers are governed by a number of standards, e.g. SAE J1978 Rev. 1998-02 and SAE J1979 Rev. 1997-09. Compared to code readers, scan tools are relatively expensive diagnostic devices that have a larger number of features.

There are different types of scan tools. An "OBD-2 Scan 45 Tool" complies with the above-identified specifications. By contrast, a "manufacturer-specific scan tool" is a scan tool that accesses and displays proprietary manufacturer-specific data (and may also access and display OBD 2 data).

Examples of such manufacturer specific data includes Device Controls on General Motors vehicles; On-Demand Tests in Ford vehicles; and Actuator Tests, Sensor Tests, Interrogator, and Read Temporary Codes in Chrysler vehicles. In general, air bag data, ABS data, cruise control data, and climate control data are also considered to be proprietary manufacturer-specific data and are typically accessible only by manufacturer-specific scan tools.

As noted above, a code reader is a relatively basic off-board device that links with one or more computer modules in a vehicle diagnostic system via a vehicle computer network, retrieves any diagnostic trouble codes (referred to as "diagnostic codes" herein) generated by the vehicle diagnostic system and displays any diagnostic codes on a display. Typical code readers do not perform the following major functions that are performed by typical scan tools: "View Data," also known as "Live Data," "Freeze Frame Data," and "Data Test, DTC" (viewing and displaying data, such as captured fixed data and real-time live, changing data from a plurality of module sensors), display of textual diagnostic descriptions corresponding to the various diagnostic codes, recording and playback of data, device control (manually controlling modules for diagnostic purposes), and reading and displaying vehicle information from the vehicle's computer (e.g. VIN information, controller calibration identification number, etc.). The data typically includes values (e.g. volts, rpm, temperature, speed, etc.) and system status information (e.g. open loop, closed, fuel system status, etc.) generated by the vehicle sensors, switches and actuators. (Digital Can OBD-2 Scan Tool Manual p. 40).

The Enhanced OBD-2 Scan Tool by Innova Electronics Corp. is typical of scan tools wherein the problem diagnostic trouble codes (DTCs) and live data may be displayed. However, the live data can amount to several hundred readings which a user may need to scan through in order to identify the problem readings.

Due to the increasing complexity of vehicle electrical systems and components, many of which are made by companies other than the vehicle manufacturer and utilize different operating protocols, sorting and evaluating the available vehicle information can be a daunting task. Aftermarket scan tools face the challenge of being able to access and process information not only from the ECU, but also from various associated electrical devices. Moreover, given the inter-relatedness of vehicle electrical systems and onboard devices, defects in relation to one onboard electrical device may cause defects in other electrical devices, resulting in multiple digital trouble codes, the ultimate cause of which may be yet another device or circuit that does not directly correspond to any of the digital trouble codes identified in the ECU. The inherent complexity of such systems is compounded by the number of different makes and models of vehicles that are available, and the changes to those vehicles over the years that they are offered. For aftermarket scan tools to have a practical value to ordinary consumers, the scan tools must be relatively inexpensive and constructed as a handheld device that is simple to operate, despite the complexity of the diagnostic functions being implemented by the device.

The numerous challenges to the development of such consumer friendly scan tools have encouraged scan tool manufacturers to consistently seek new ways for accessing, interpreting, processing vehicle diagnostic data, to accurately identify vehicle defects and to derive reliable solutions thereto.

As described below, one implementation of the present invention is directed to a scan tool, and method of the scan tool operation, which leverages the capabilities of contemporary ECUs to derive and process certain diagnostic data, in conjunction with indexed databases that enhance the ability to communicate with the onboard electrical devices and the processing of data derived therefrom.

Another implementation of the present invention utilizes historical information respecting the operation of vehicle systems and electrical devices as a further basis to identify and evaluate vehicle defects and the most likely solutions therefore.

These and other objects and advantages associated with the present invention are described in more detail below, in conjunction with the appended drawings and claims.

BRIEF SUMMARY OF THE INVENTION

A diagnostic scan tool is provided including an input port configured to be engageable to, or otherwise in communication with a vehicle diagnostic port. A connect/configure module may be provided for establishing a communication link between the scan tool and a vehicle electronic control unit (ECU). The connect/configure module may also be operative to poll the ECU to determine a proper connect protocol. Using that protocol the connect/configure module can operate to retrieve the vehicle identification number (VIN) or other vehicle identifying information from the ECU. Alternatively, the VIN or other vehicle identifying information may be input by a user or scanned from the vehicle.

A vehicle specification module is operative to identify a vehicle under test in response to receipt of the VIN. The vehicle specification module may also be operative to identify communication protocols between the ECU and a plurality of vehicle onboard devices. A trouble code module retrieves DTC's from the ECU. A freeze frame data module is provided for retrieving freeze frame data from the ECU, the retrieved freeze frame data, or portion thereof, being representative of the operation of the vehicle onboard device(s) related to the highest priority DTC. A database includes a list of possible vehicle defect solutions, indexed to the VIN and the DTCs. A digital signal processor is provided to derive the highest priority DTC from the freeze frame data, or relevant portion thereof, and to regulate selection of a most likely vehicle defect solution associated with the VIN, and the highest priority DTC.

The digital signal processor may be further operative to compare the retrieved freeze frame data to stored freeze frame data corresponding to the defect solution associated with the highest priority DTC, to identify any anomaly(s) therebetween. The digital signal processor may then regulate selection of the most likely defect solution by excluding any defect solution that is inconsistent with the retrieved freeze frame data.

Where a plurality of defect solutions are potentially associated with the highest priority DTC, the digital signal processor may be further operative to identify an alternative most likely defect solution(s), where the retrieved freeze frame data is inconsistent with the originally identified most likely defect solution.

Where the retrieved freeze frame data is inconsistent with each of the defect solutions associated with the highest priority DTC, an alternate DTC may be identified as the highest priority DTC, whereupon the analysis may be repeated for such alternate DTC.

Where combinations of DTCs are downloaded from the ECU, additional/alternative processing steps may be implemented to identify the most likely defect solution. In one embodiment, combinations of DTCs are stored in the database, with each stored combination being associated with a defect solution. In that embodiment the digital signal processor is operative to identify a most probable defect solution based upon a probabilistic comparison of the combination of received sets of DTCs to the stored combinations of DTCs, wherein the defect solution associated with closest stored combination of DTCs is identified as the most likely defect solution.

In one embodiment the scan tool is operative to identify the most likely defect solution, and/or the highest priority DTC, in response to connecting the scan tool to the vehicle diagnostic port, independent of any further user input.

Where the scan tool is in wireless communication with the ECU, the scan tool may be operative to derive the most likely defect solution, and/or the highest priority DTC, in response to the establishment of a wireless communication link between the scan tool and the ECU, independent of any further user input.

The database may be disposed within the scan tool and/or remotely located relative to the scan tool. Where the database is remotely located, the scan tool may also be configured for wired or wireless communication with the remote database.

In some embodiments the vehicle specification module and/or the database may be implemented to include updatable flash memory units.

The scan tool may also include a display for displaying information such as the received DTCs, the highest priority DTC, the retrieved freeze frame data, the stored freeze frame data, the most likely defect solution, and other information.

According to another embodiment, there is provided automotive diagnostic system including a diagnostic device for communicating with the ECU. A diagnostic database is in communication with the diagnostic device, wherein the database lists possible vehicle defect solutions indexed to DTC's and the VIN. A digital signal processor is disposable in communication with at least one of the diagnostic device and the diagnostic database and being operative to derive the highest priority DTC from analysis of the retrieved DTC's and the retrieved freeze frame data, and to regulate selection of a most likely vehicle defect solution associated with the VIN and the highest priority DTC. A repair parts database may be in operative communication with the diagnostic database, with the repair parts database having repair parts associated with universal part numbers and vehicle identification information.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION OF THE PRESENTLY PREFERRED EMBODIMENT

Figure 1:
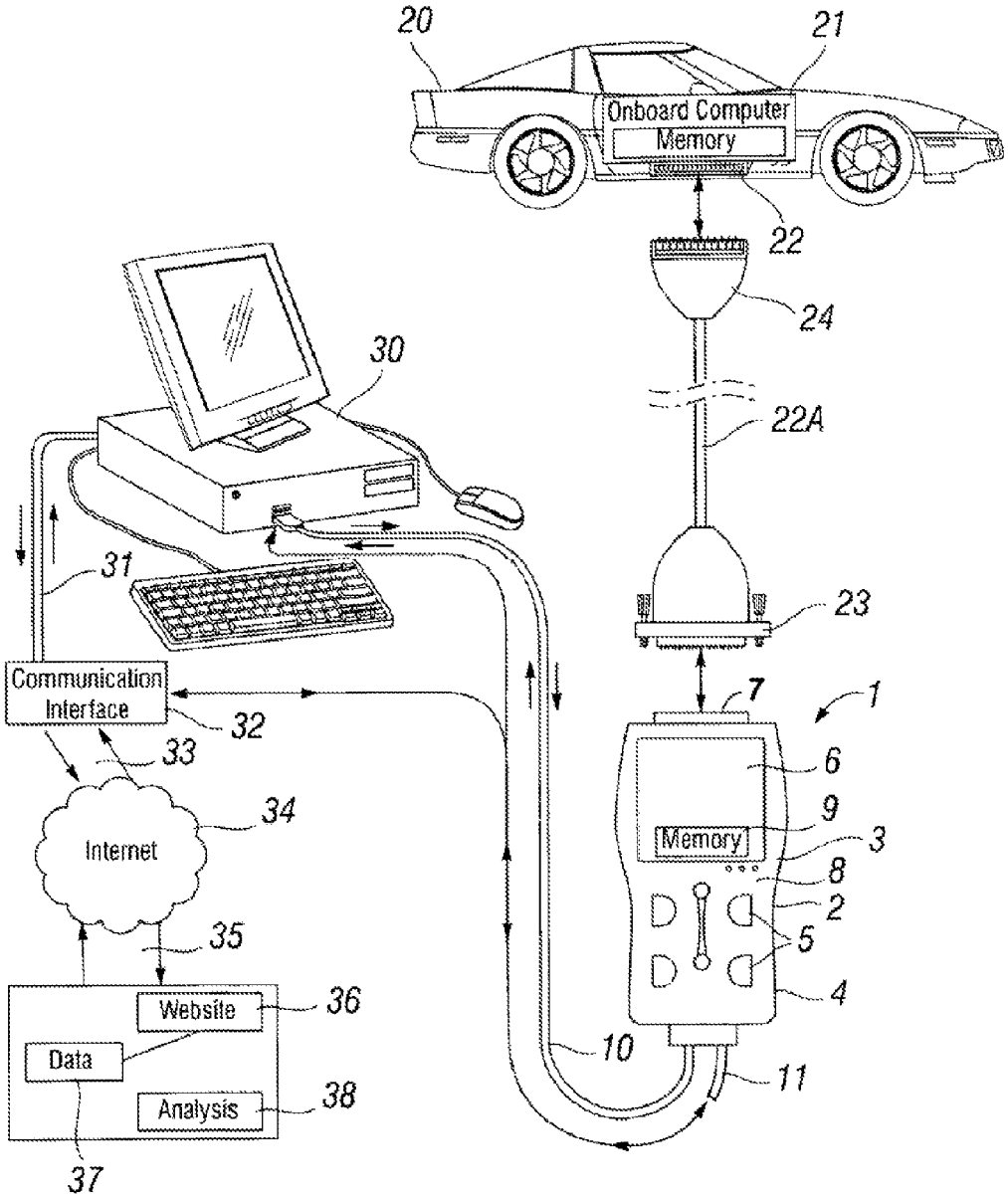
FIG. 1 is an illustration showing how the portable code reader/scanner interfaces to the automobile.

Referring to FIG. 1, the portable code reader/scanner 1 is comprised of a housing 2 enclosing a hollow interior 3. The exterior 4 of the housing is comprised of a keyboard 5 and a display 6 and a sixteen (16) pin connector 7 at one end.

The interior 3 of the portable code reader/scanner is comprised of a processor 8 and memory 9 containing information concerning the vehicle, as well as information identifying possible vehicle defect solutions, indexed to the VIN (vehicle identification number) and the DTCs (diagnostic trouble codes). There also may be a cable connection 10 or a wireless Bluetooth™ connection 11 to a personal desktop or laptop computer 30. The handheld connector 7 interfaces with an automobile 20 onboard computer 21, either directly or with an intervening vehicle interface cable connector 22A having a handheld portable testing device fitting 23 and a car fitting 24.

In one implementation the personal computer may have a wired or wireless connection 31 to a communication interface 32, which in turn may be connected 33 with the internet 34. The portable code reader/scanner 1 may then be connected, via communication line 35, to website 36 containing data base 37, and is capable of analysis 38 of the data received from the coder reader/scanner 1.

The diagnostic functions of the code reader/scanner 1 may be enhanced by using the resources of a remote database that facilitates processing of the diagnostic data in relation to resources such as historical diagnostic information based on prior repairs of other vehicles, information concerning predicted repairs, etc. Communication with the remote database may be via a personal computer, via communication link with a cellphone, or other means.

Figure 2:
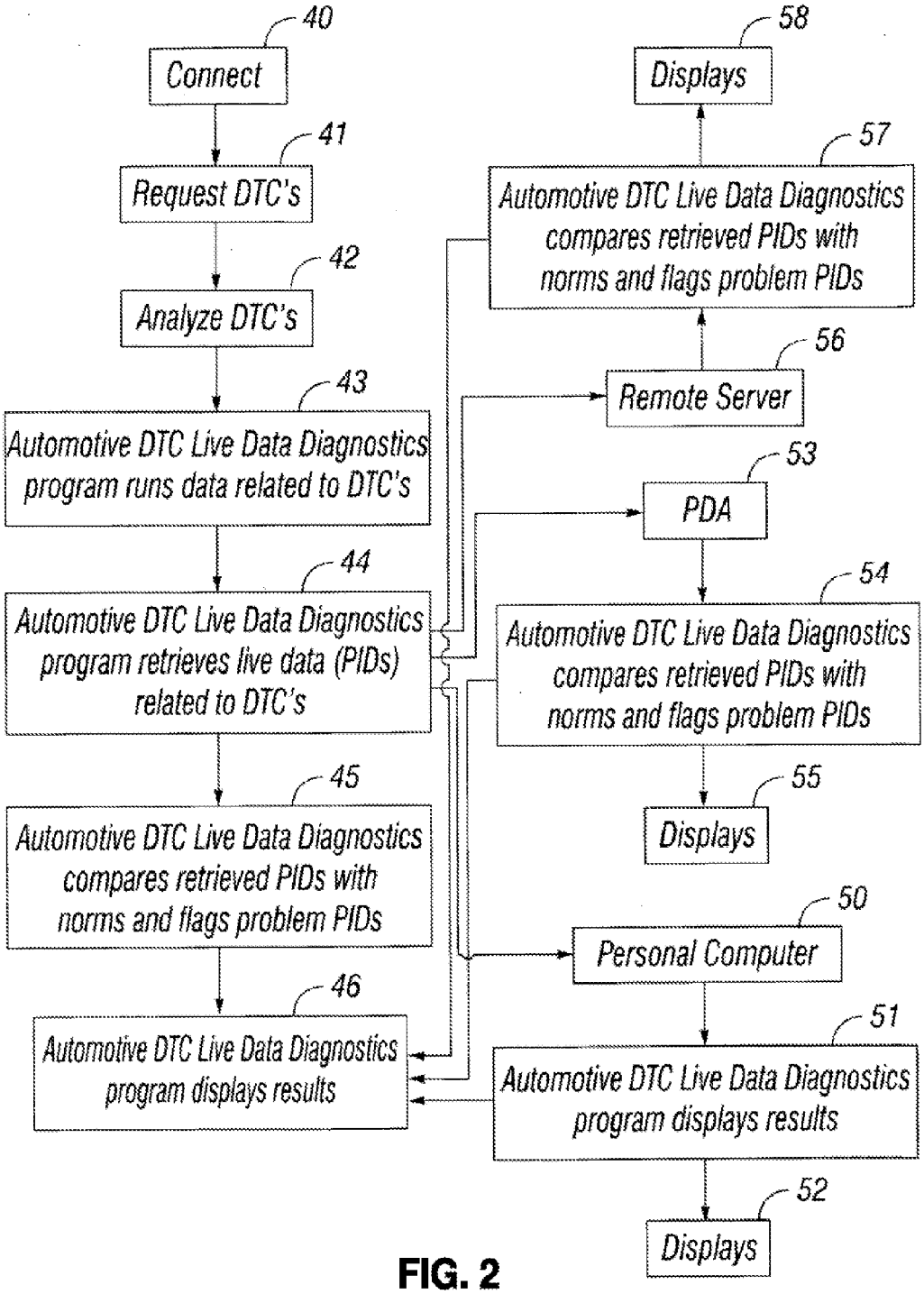
FIG. 2 is a flow diagram illustrating various ways of using the live (in real-time) data analysis program.

In one embodiment, shown at FIG. 2, the portable code reader/scanner 1 is connected to 40 the automobile 20 onboard computer 21. At this point, the diagnostic trouble codes, DTCs, may be requested 41 in order to determine problem areas. The DTCs are then analyzed 42. The portable code reader/scanner 1 is placed in the request live data mode 41 and the automotive DTC live data diagnostics program proceeds to analyze and send commands to the onboard computer 22 requesting specific live data in real-time that were used generate the DTCs 44.

The live data typically includes PIDs and related tests. The live data diagnostic program compares the retrieved PIDs within the ranges of normalcy (norms) within the database and flags the problem PIDs 45, i.e. PIDs that are outside the norms. The results are then displayed 46.

In another embodiment, the portable code reader/scanner 1 is connected to 40 the automobile 20 onboard computer 21. At this point, the diagnostic trouble codes, DTCs, may be requested 41 in order to determine problem areas. The DTCs are then analyzed 42. The portable code reader/scanner 1 is placed in the request live data mode 41 and the automotive DTC data diagnostic program proceeds to analyze and send commands to the onboard computer 22 requesting specific data related to the DTC(s), in real time.

"Related data" that is retrieved may be limited to data that caused a DTC to be generated; data generated at a time proximate the time that a DTC was generated; and/or data that is otherwise deemed functionally related to a DTC.

In response to a request for freeze frame data, the ECU will typically provide freeze frame data reflecting the vehicle conditions that caused reporting of the DTC which the ECU considers to be the highest priority DTC. That freeze frame data will typically identify the highest priority DTC, either in the data itself, or in a storage location identified by the data. Along these lines, the freeze frame data may include operational data, as well as a "freeze frame" DTC, which may be compared to the other DTC(s) retrieved from the ECU for purposes of identifying the highest ranked DTC. In some cases, additional data may also be retrieved where a comparison with similar stored data is desired. The retrieved DTCs and related data may be sent to a personal computer 30 which contains database information concerning the vehicle automotive DTCs and data diagnostics corresponding to information and programming in the portable coder reader/scanner.

The personal computer 30 uses the automotive DTC data diagnostics program and compares the retrieved data (PIDs) within range of normalcy (norms) and flags the problem PIDs 51. The personal computer 30 may display the PIDs 52 and/or return them to the portable code reader/scanner 1 for display 46.

In another embodiment, the portable code reader/scanner 1 is connected 40 to the automobile 20 onboard computer 21. At this point, the diagnostic trouble codes, DTCs, may be requested 41 in order to determine problem areas. The DTCs are then analyzed 42. The portable code reader/scanner 1 is placed in the request data mode 41 and the automotive DTC data diagnostic program proceeds to analyze and send commands to the onboard computer 22 requesting, for example, freeze frame data. The results of the analysis are sent to a PDA 53 which may contain the same database information concerning the automotive DTC data diagnostics program as the portable code reader/scanner.

The PDA may also use the automotive DTC data diagnostics program to compare the retrieved PIDs to ranges of normalcy (norms), and flag the problem PIDs 55. The PDA 30 may display the PIDs 55 and/or return them to the portable code reader/scanner 1 for display 46.

In a further embodiment, the handheld portable testing device 1 is connected to 40 the automobile 20 onboard computer 21. At this point, the diagnostic trouble codes, DTCs, may be requested 41 in order to determine problem areas. The DTCs are then analyzed 42. The portable code reader/scanner 1 may then be placed in the request data mode 41 and the automobile DTC live data diagnostics program proceeds to analyze and send commands to the onboard computer 22 requesting specific data, such as the data that was used to generate the DTCs 44. The results are sent to a remote server 56, which contains the same database information concerning the vehicle selective data retrieval program as the portable code reader/scanner. The remote server 56 uses the automotive DTC data diagnostics program to compare 57 the retrieved PIDs within ranges of normalcy (norms) 37 and flag 38 the problem PIDs 51. The PDA may display the PIDs 58 and/or return them to the portable code reader/scanner 1 for display 46.

Figure 3:
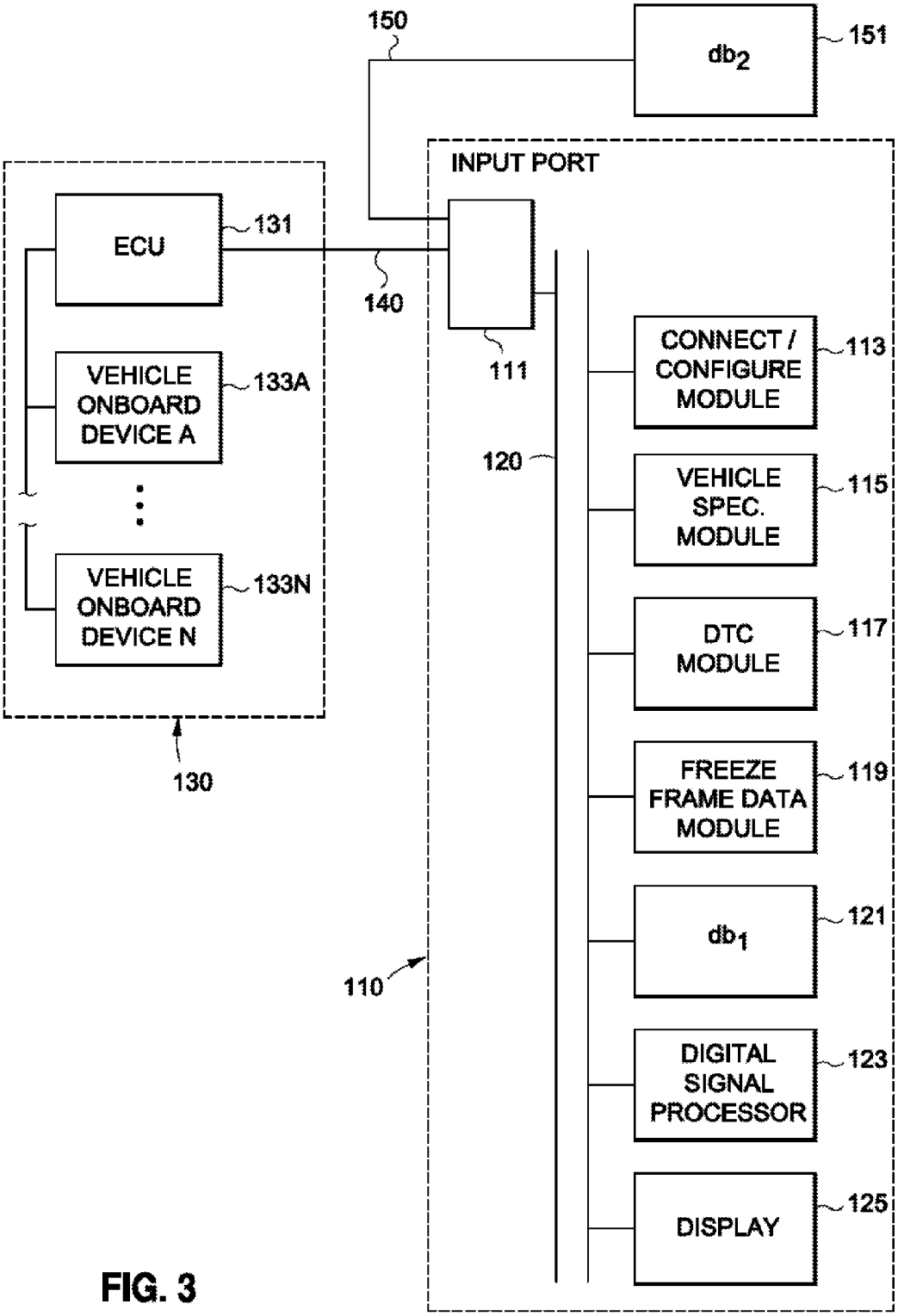
FIG. 3 is a block diagram illustrating an exemplary configuration of a diagnostic scan tool in accordance with the present invention.

FIG. 3 is a block diagram further illustrating an exemplary configuration of a diagnostic scan tool in accordance with the present invention. As shown in FIG. 3, scan tool 110 includes an input port 111 configured to be in electrical communication with ECU 131. The connection 140 between the input port and ECU may be a wired connection through a vehicle diagnostic port, a wireless connection, or some combination thereof.

Scan tool 110 may further include a connect/configure module 113 for establishing a communication link between the scan tool 110 and ECU 131. The connect/configure module 113 may be operative to poll the ECU 131 to determine a proper connect protocol for initiating communication link between the scan tool 110 and the ECU 131. As described below the proper connect protocol can alternatively be derived from scanned VIN information, which can be correlated to a vehicle configuration database Where the ECU is polled, the scan tool 110 may include a vehicle specification module 115 operative to identify a vehicle under test in response to receipt of a vehicle information number (VIN). In one embodiment, the VIN, or other vehicle identifying information, is received from the ECU, in response to polling the ECU, as described above. In another embodiment the VIN, or other vehicle identifying information, is optically scanned on the car, or manually entered into the tool.

The VIN, or other vehicle identifying information, may be used to access information which details the structure and functional operation of the vehicle under test, and facilitates selection of the most likely vehicle defect solution. The vehicle specification module 115 may be used to identify the operating parameters of various vehicle onboard devices, and the operating communication protocols that such devices utilize in communications with the ECU, PIDs, etc.

As those of ordinary skill will recognize, a polling process may be to derive various communications protocols used by the ECU. However, such a polling process may introduce a substantial delay in the operation of the scan tool. Moreover, repeating the polling process each time the scan tool desires to communicate with a different vehicle onboard device introduces a further delay in the operation of the scan tool. In accordance with the present invention the vehicle specification module can use the VIN, or other vehicle identifying information, which retrieved from the ECU or otherwise obtained, to access relevant stored information identifying the communication protocols and other operating parameters applicable to the various vehicle onboard devices. The vehicle specification module then configures the scan tool to communicate with those devices, as desired, without a need for repeating the polling process for each device for which data is sought.

The VIN information may alternatively be derived using an optical scanner user input. As indicated above, the VIN information may then be used to derive the proper ECU protocol, device protocols, PID set, $PID_{min/nom/max}$ and other vehicle configuration data.

The scan tool 110 further includes a digital trouble code module 117 for receiving digital trouble codes (DTC) from the ECU. While contemporary ECUs are not known to prioritize DTC's output from the ECU, at least some ECUs are operative to inferentially identify the highest priority DTC, by analysis of the ECU's selection of freeze frame data output to the tool. Thus, while the ECU does not specifically identify the highest priority DTC to the tool, the highest priority DTC can be identified or derived by the tool from an analysis of the freeze frame data, i.e. identifying the DTC associated with that freeze frame data. Along these lines, the freeze frame information typically includes operational data, along with a "freeze frame" DTC, which is used as the highest priority DTC. When a problematic condition arises, freeze frame operational data is stored along with the freeze frame DTC. As other operational conditions arise, the internal programming of the ECU determines when to override the existing freeze frame DTC with the new DTC. When the operational information is associated with a higher priority vehicle system, the existing freeze frame DTC is replaced with the newer DTC, and thus, the newer DTC becomes the freeze frame DTC. However, if the existing freeze frame DTC is associated with a higher priority system than the system associated with the newer operational data, than the existing freeze frame DTC remains the freeze frame DTC. Identification of the highest priority DTC may then be used to derive the most likely defect in a vehicle under test. The ECU's selection of freeze frame data, and therefore the identification of the highest priority DTC may change as additional DTC's are retrieved and reported by the ECU. Moreover, as described below, the present invention may change the identification of the highest priority DTC based on an evaluation of other diagnostic data and historical/reference data.

The scan tool 110 may further include a database 121, i.e. $db_1$, listing possible defect solutions indexed to the DTCs and the VIN. The database may be configured for a particular vehicle and include at least one vehicle defect solution indexed to a DTC generated by a specific make/model/year/etc. vehicle. More commonly, the database may include multiple defect solutions associated with a single DTC, for the same vehicle. In such cases, live data or reference data may be used to prioritize among multiple possible solutions.

A digital processor is provided in the scan tool 110, in electrical communication with the ECU 131, the connect/configure module 113, the vehicle specification module 115, the DTC module 117, the freeze frame data module 119, the database 121, and display 125. The digital signal processor is operative, inter alia, to regulate selection of a most likely defect solution associated with the VIN, the highest priority DTC and, in some cases, the collective retrieved freeze frame data or live data.

The database 121 may further include nominal freeze frame data, indexed to the vehicle onboard devices. The digital signal processor 123 may be configured to compare the retrieved freeze frame data to the corresponding nominal freeze frame data, to identify any anomalies therebetween. Such anomalies may be useful to confirm whether or not the vehicle onboard device from which the received freeze frame data originates is defective. The database 121 may further be configured to include freeze frame data associated with the possible defect vehicle solutions. In such embodiment, the digital signal processor 123 may be operative to compare the retrieved freeze frame data to the stored nominal freeze frame data, or freeze frame data corresponding with the most likely defect solution, to confirm the most likely defect solution, or to indicate that the defect solution identified as the most likely defect solution is actually not the most likely defect solution. In that case, the next most likely defect solution may be selected as the defect solution, or an alternate DTC may be identified as the highest priority DTC, where after an evaluation of the most likely defect solution begins again.

As it will be apparent to those of ordinary skill in the field, the specific steps in implementing the functionalities described above may be varied without departing from the scope and spirit of the present invention. As such, the various stored data, e.g. VIN information, protocol information, possible defect solutions, nominal freeze frame data, and/or freeze frame data corresponding with possible defect solutions may be stored in a common database, such as database 121, an associated personal computer, and/or distributed in different modules. Similarly, such information may be stored in the remote database 151, accessible by communication link 150, which may be hard wired and/or wireless. The database 151, i.e. $db_2$, may be located on a website accessible by the scan tool, either by a wire connection or linkage through a wireless network, such as a cellphone network or satellite communication system.

In some implementations, the scan tool functions may be automatically implemented in response to connecting the tool to the vehicle diagnostic port, or otherwise establishing a communication link between the scan tool and the ECU. Where the particular ECUs is operative to output prioritized DTC's (e.g. based on the sequence generated) and capture related live data, the scan tool may be operative to autonomously identify the highest priority DTC, evaluate the freeze frame data, and derive the most likely defect solution in response to connecting the tool to the vehicle diagnostic port, or otherwise establishing a communication link between the scan tool and the ECU, independent of any further diagnostic processes of user input.

In one embodiment the database 121 is implemented as an updatable flash memory unit. The remote database 151 may similarly include an updatable flash memory unit.

In one embodiment the database 121, and/or database 151, may include a historical database having stored combinations of DTCs, along with the particular defect solution identified for each stored combination of DTCs. The scan tool 110 may be configured to implement a probabilistic comparison of the received combinations of DTCs to stored combinations of DTCs, to identify the highest stored combination, i.e. the highest ranked stored combinations of DTCs, even if no individual DTC is identified as the highest priority DTC. The defect solution associated with the highest ranked stored combination of DTCs may be identified as the most likely defect solution. Such a probabilistic comparison may be used to initially generate a most likely solution, to confirm a prior identification of the most likely defect solution, to initially provide a most likely defect solution, or as back-up technique, e.g. where none of the previously identified defect solutions appear to be consistent with the retrieved freeze frame data or other diagnostic data received from the ECU.

A process of implementing such a probabilistic analysis is further described in U.S. patent application Ser. No. 12/715,181, referenced above, the contents of which are incorporated herein by reference.

Figure 4:
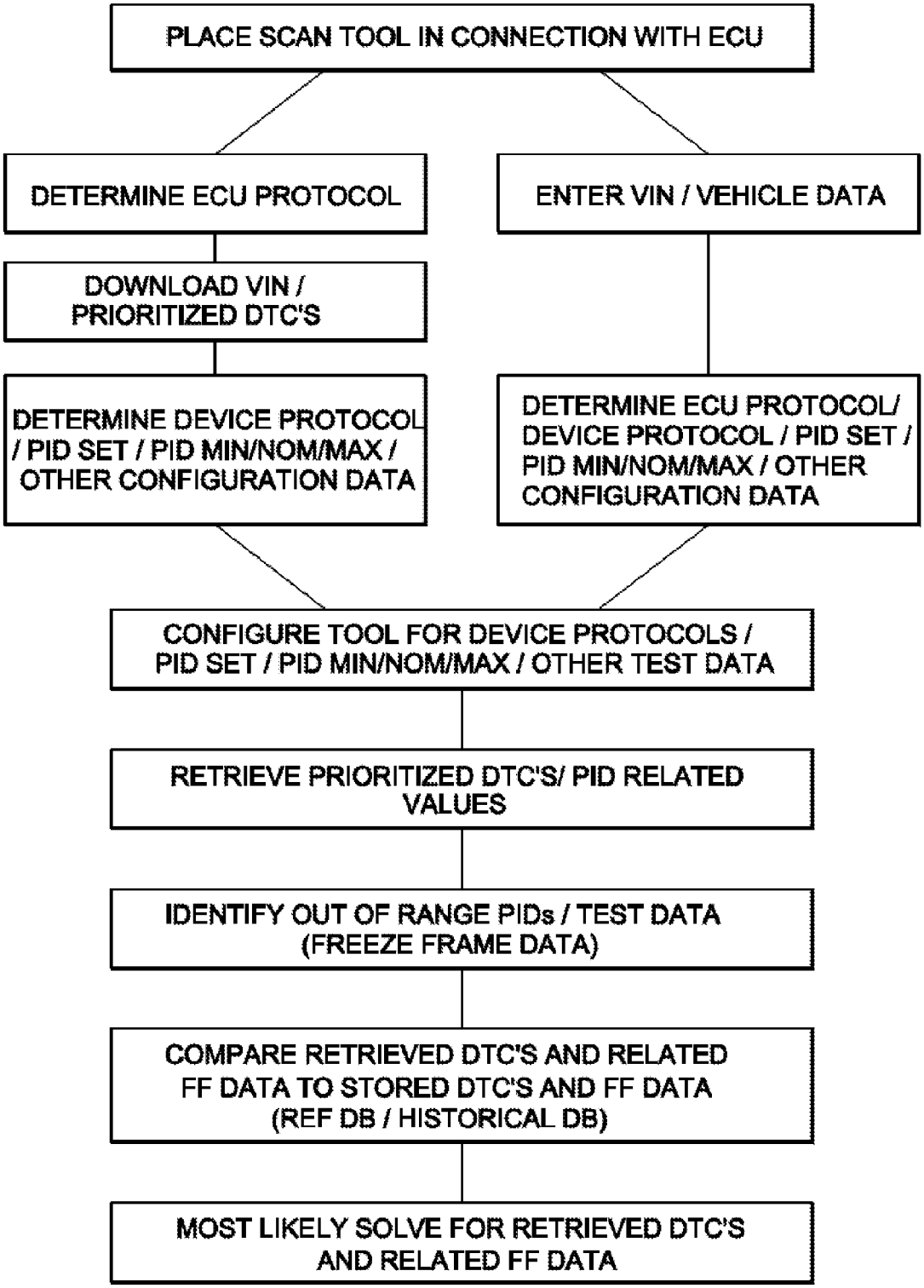
FIG. 4 is a flow diagram indicating exemplary processes for implementing diagnostic functions in accordance with the present invention.

Referring to FIG. 4, the description of an exemplary process for implementing the present invention is provided. In accordance with process, the scan tool is initially placed in communication with the ECU. In one implementation, the scan tool polls the ECU to determine the ECU protocol. Once the communication is initiated using the identified ECU protocol, the VIN, or other vehicle identifying information and the DTCs may be downloaded from the ECU. The VIN information, or other vehicle identifying information, may be used to derive additional configuration data, such as the protocol of the individual electronic devices, the PID set, the $PID_{min/nom/max}$, and other configuration data.

The tool may then be configured and related PID values and other test data retrieved. Out of range PIDs and live data (collectively freeze frame data) may be identified from comparison to corresponding reference data. The most likely solution may be derived from the VIN, the highest priority DTC and the analysis of PID values and other data, as described above.

In an alternate implementation, the VIN, or other vehicle identifying information, may be derived independent of communication with ECU, such as by optically scanning the VIN information or user input of the VIN information, or make/model/year information. That information may be used to derive configuration data, by use of a database indexed to the VIN and the tool may then be configured.

As noted above, the most likely solution may then be derived using the techniques described above.

In another implementation, the most likely solution may be derived (e.g. at a remote database) by comparison of the combination of DTCs to stored combinations of DTCs, where in the stored combinations of DTCs are associated with historically identified solutions. The most likely solution may be identified as that solution which corresponds to the highest ranked combination of stored DTCs. Freeze frame data may be used to confirm that solution, and/or to differentiate among multiple possible solutions associated with a stored combination of DTCs.

Additional data may also be considered in identifying the most likely solution. For example, the reference database may be configured to include vehicle historical data, data regarding the location/climate in which the vehicle operates, vehicle mileage data, and/or predicted repairs/replacements. For example, such data may include a list of defects predicted for a specific vehicle, associated with specific mileage ranges. As a vehicle approaches or exceeds the mileage at which such predicted defects may occur, those defects may be given higher priority in evaluating the most likely solution. Similarly, where certain defects are likely to arise as a result of operation in extreme climates, those defects may be given priority where the information confirms that such climate considerations are applicable to the vehicle under test.

As will be recognized by one skilled in the art, the above programming examples are presented as one method of programming. Other programming techniques may be utilized to implement the described diagnostic methods.

The foregoing discussion primarily relates to determining a most likely defect or solution based on information retrieved from the vehicle. The following discussion relates to identification of replacement or repair parts associated with the most likely solution.

Figure 5:
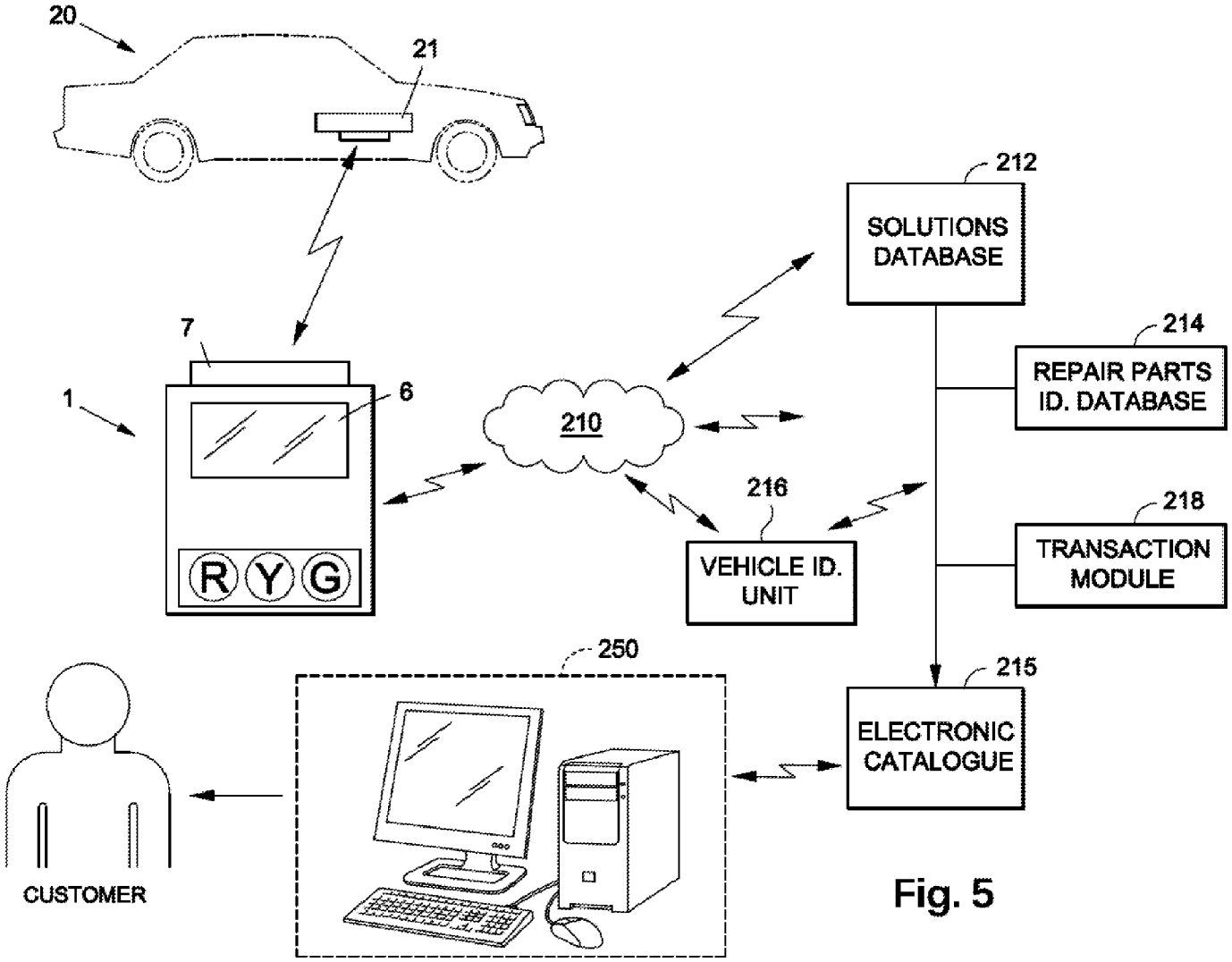
FIG. 5 is a schematic view of an automotive diagnostic system in accordance with another embodiment of the present invention.
Figure 6:
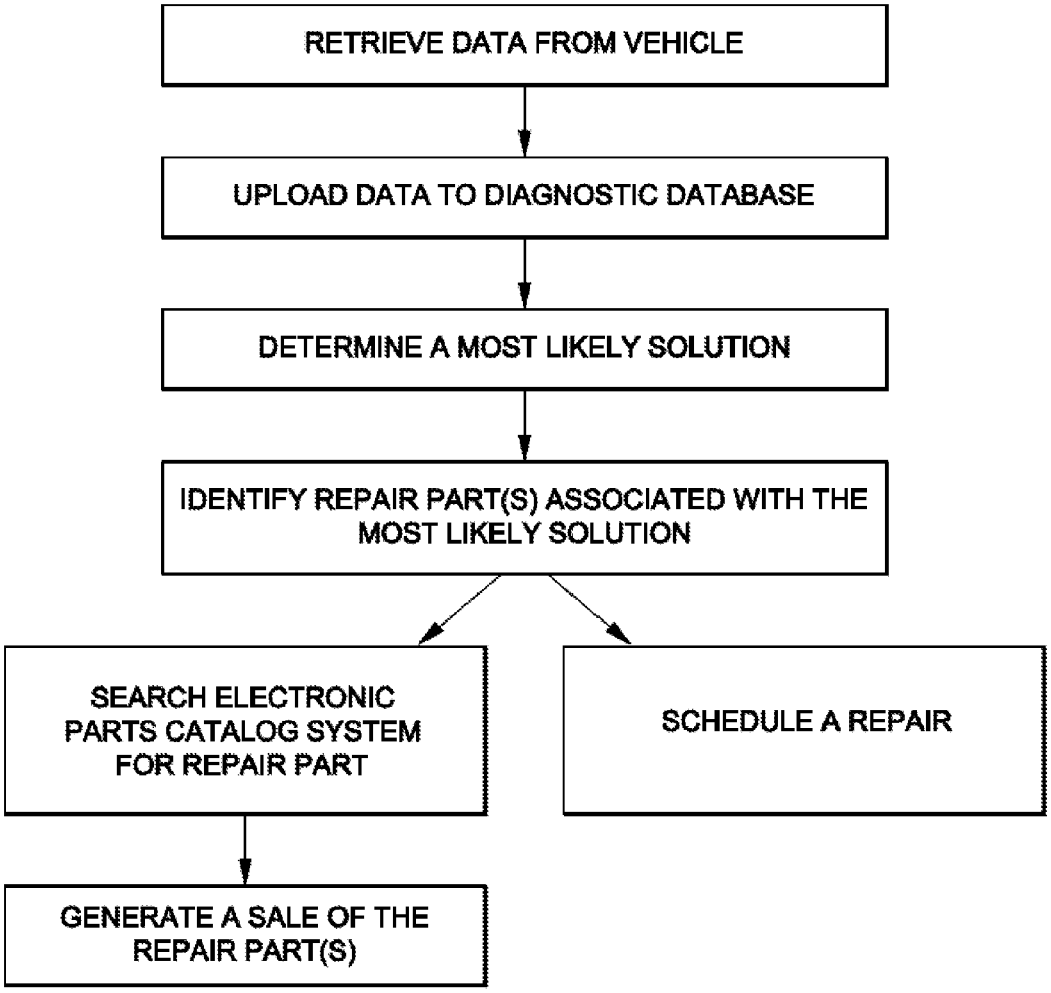
FIG. 6 is a flow chart for an automotive diagnostic method in accordance with the system depicted in FIG. 5.

Referring now to FIG. 5, there is shown an automotive diagnostic system specifically configured and adapted to more easily identify a repair part for a vehicle 20. A diagnostic device 1 (e.g., scan tool, data logger, dongle, etc.) is connected to the onboard vehicle computer 21 to retrieve data and information therefrom, as described above. The diagnostic device 1 shown in FIG. 5 is a dongle which is connected to the OBD-II port on the vehicle 20 for communicating with the onboard computer 21. In this respect, the term "diagnostic device" is used herein to broadly refer to unsophisticated devices (e.g., a dongle) which simply retrieve and transfer data, to more sophisticated devices (e.g., scan tools) having onboard diagnostic processing and display capabilities.

The data retrieved from the vehicle 20 may include diagnostic data, such as DTCs, freeze frame data, and other data commonly retrieved from the onboard computer 21, in addition to vehicle identification information. Such vehicle identification information may include the vehicle identification number (VIN) or alternatively the year, make, model, and engine type of the vehicle. The diagnostic data and vehicle information retrieved from the onboard computer may be analyzed locally on the device 1 or uploaded to a communications network 210. The uploading of diagnostic data and vehicle information may be facilitated through the use of an intermediate communication device, such as a smart phone, tablet computer, personal computer or other intermediate communication devices known, or later developed, by those skilled in the art. Furthermore, the communication network 210 may include the Internet, a telephone communication network, a local area network, or other communication networks known in the art.

The diagnostic data may be communicated to a solution database 212 from the communication network 210. The solution database 212 is configured to match the diagnostic data with stored solutions to identify a most likely solution that is associated with the uploaded diagnostic data. As described above, the solution database may alternatively be integrated directly into the diagnostic device 1. In some cases, the most likely solution may be as simple as ensuring that the gas cap is properly secured to the vehicle. In other cases, the most likely solution will require a repair part. For instance, the most likely solution may be that a mass airflow sensor needs to be replaced.

When the most likely solution involves a repair part, the most likely solution is communicated to a repair parts identification database 214, which includes repair parts organized according to the most likely solution and the vehicle identification information. The repair part may also be matched with a universal part identification number. An example of a universal parts identification system is the Aftermarket Catalog Enhanced Standard (ACES) parts numbering system, although other universally accepted parts identification systems may also be used in connection with the present invention without departing from the spirit and scope of the present invention.

The repair part identified by the solutions database 212 may be matched with the parts listed in the repair parts identification database 214 to determine the universal part number associated with the repair part. It is understood that a given part (e.g., a mass airflow sensor) may vary from one vehicle to the next. Accordingly, there may be several universal part identification numbers associated with the different mass airflow sensors. As such, in order to identify a specific mass airflow sensor that is adapted for use with a specific vehicle, vehicle identification information is required. Thus, the repair parts identification database 214 may receive that vehicle identification information as part of the upload from the tool 1. Alternatively, the repair parts identification database 214 may receive a universal vehicle identification number from a vehicle identification unit 216, as will be explained in more detail below.

It is also contemplated that in addition to parts being assigned universal identification numbers, vehicles may also be assigned a universal vehicle identification number, which corresponds to vehicles having the same year, make, model, and engine type. Thus, once a vehicle 20 has been identified, the specific parts used on that vehicle 20 may also be identified. Consequently, each universal vehicle identification number will be associated with various universal part identification numbers. When the vehicle 20 under consideration has been identified, the universal part numbers associated with the vehicle 20 may be focused on to simplify the analysis.

The diagnostic methods described herein may be useful in various e-commerce applications. For instance, when the system identifies a most likely defect and/or a repair part or procedure associated with the most likely defect, the system may take steps to quickly effectuate the repair. One particular aspect of the system is that certain steps in the overall process may proceed automatically, without any input from the user, thereby reducing the burden on the user.

The system may also be configured to search one or more online databases to find prices for repair parts or services associated with a particular ACES part number. For instance, the cost for a particular part associated with a particular part number may be collected from a host of different retailers. Furthermore, the service for installing the part may also be collected from a host of different service locations/repair shops. The collected prices may be displayed on the user's computer, smartphone or other display device to allow the user to select which vendor to complete the sale.

According to one embodiment, diagnostic data (e.g., DTCs, Freeze Frame data, etc.) may be automatically uploaded from the device 1 to a diagnostic database, such as the solution database 212. The upload of diagnostic data may be completed through the use of an intermediate device, such as a cellphone, or the tool 1 may include onboard hardware capable of uploading the information directly. The data may be uploaded in response to a command entered by the user (e.g., the user actuating a button on the device 1 or a linked device, such as a smartphone), or in response to a predefined triggering condition. For instance, the device 1 may be associated with a particular parts store 250 such that when the vehicle 20 (having the device 1 plugged into the vehicle 20) enters a predefined area around the parts store 250, such as the parking lot, the device 1 automatically uploads the information to the diagnostic databases 212 associated with the parts store 250. The triggering condition is not limited to the device 1 moving into a predefined area around the parts store 250. Rather, the predefined triggering condition may also include one of the following: the device 1 being in wireless communication with a predefined wireless network (e.g., public or private Internet access), the device 1 moving into a predefined area around a service garage, the device 1 returning home or to a garage, the engine being turned ON, the engine being turned OFF, a DTC being generated by the vehicle. Of course, those skilled in the art will appreciate that the aforementioned triggering conditions are exemplary in nature only, and are not intended to limit the scope of the present invention. Along these lines, other triggering conditions known in the art may also be used without departing from the spirit and scope of the present invention.

Once the information from the vehicle 20 is uploaded to the diagnostic databases 212, a most likely solution is determined, along with a corresponding repair part. As with the upload of diagnostic information to the database 212, the analysis of the diagnostic information at the database 212 may be completed automatically without input from the user, and potentially without the user being aware of the process implementation.

According to one embodiment, the system may automatically complete the sale of the repair part to expedite the repair if certain conditions are met. For instance, the user may only want to purchase the part if the associated most likely defect is critical. Conversely, if the part is associated with a non-critical defect, the user may be prompted for authorization to complete the sale of the part.

The process of completing the sale of the repair part may include establishing a link between the diagnostic database 212 and an electronically searchable parts catalog or database 215 to determine if the parts store 250 carries the specific repair part needed (e.g., the repair part associated with the specific part number), if the repair part is in stock, as well as determining the price of the repair part. The search of the parts database 215 may be completed automatically without any input from the user. It is contemplated that a plurality of parts databases 215 associated with different parts stores may be searched to find the nearest repair part and/or the least expensive repair part. A transaction module 218 may be in communication with the repair parts identification database 214 and an electronic catalogue 215 associated with the parts store 250 for effectuating the sale.

The system may be configured to automatically ship the part to the user to allow the user to complete the repair. Alternatively, the part may be set aside for the user at the parts store for pickup. In other embodiments, the sale of the part may not be completed until the user arrives at the store. The user may be sent part tracking information to enable quick and easy completion of the sale once the user arrives at the store. For instance, the system may send an email and/or text message to the user with a reference number, tracking number, bar code, or other transaction identification information to simplify the sale when the user arrives at the store. The part information may also be displayed for the customer at the parts store to allow the customer to visually confirm the information prior to purchase.

In addition to automatically generating a sale of the part, the system may also automatically schedule a repair to install the new repair part. The automatic scheduling of the repair may be particularly useful in fleet management applications. When a repair is automatically scheduled, the user/fleet manager may be sent a message with details associated with the repair, such as the date/time of the repair, estimate time to complete the repair, cost of the parts/service, etc.

What is claimed is:

1. An automotive diagnostic system comprising:

a diagnostic device including:

a connect/configure module for establishing a communication link between the diagnostic device and a vehicle electronic control unit (ECU);

a vehicle specification module operative to identify a vehicle under test in response to receipt of vehicle identifying information from the ECU;

a trouble code module for retrieving digital trouble codes (DTC's) from the ECU; and a freeze frame data module for retrieving freeze frame data from the ECU, the retrieved freeze frame data being representative of the operation of a vehicle onboard device(s) associated with a DTC identified as the highest priority DTC;

a diagnostic database in communication with the diagnostic device, the database listing possible vehicle defect solutions indexed to DTC's and the vehicle identifying information;

a digital signal processor separate from the vehicle ECU and disposable in communication with at least one of the diagnostic device and the diagnostic database and being operative to derive the highest priority DTC from analysis of the retrieved freeze frame data from the vehicle, and to regulate selection of a most likely vehicle defect solution associated with the vehicle identifying information and the highest priority DTC; and a repair parts database in operative communication with the diagnostic database, the repair parts database having repair parts associated with the most likely solution, vehicle identifying information and universal part numbers.

2. The automotive diagnostic system recited in claim 1, wherein the universal part numbers in the repair parts database are Aftermarket Catalog Enhanced Standard (ACES) part numbers.

3. The automotive diagnostic system recited in claim 1, further comprising an electronic parts catalog in communication with the repair parts database, the electronic parts catalog being searchable for the repair parts associated with the universal part number.

4. The automotive diagnostic system recited in claim 1, further comprising a transaction module in communication with the repair parts database and configured to generate a commercial transaction associated with the identified repair parts.

5. The automotive diagnostic system recited in claim 4, wherein the commercial transaction is associated with the purchase of the repair parts.

6. The automotive diagnostic system recited in claim 4, wherein the commercial transaction is associated with a repair service.

7. The automotive diagnostic system recited in claim 1, wherein the retrieved freeze frame data includes freeze frame data representative of the electrical signals that caused the highest priority DTC to be generated.

8. The automotive diagnostic system recited in claim 1, wherein the identification of the highest priority DTC is derivable from freeze frame data.

9. The automotive diagnostic system recited in claim 1, wherein the retrieved freeze frame data includes freeze frame data including a single DTC identified as the highest priority DTC.

10. The automotive diagnostic system recited in claim 1, wherein the vehicle identifying information is the vehicle identification number (VIN).

11. An automotive diagnostic system comprising:

a data retrieving device including:

a connect/configure module for establishing a communication link between the data retrieving device and a vehicle electronic control unit (ECU);

a vehicle specification module operative to identify a vehicle under test in response to receipt of vehicle identifying information from the ECU;

a trouble code module for retrieving digital trouble codes (DTC's) from the ECU;

a freeze frame data module for retrieving freeze frame data from the ECU, the retrieved freeze frame data being representative of the operation of a vehicle onboard device(s) associated with a DTC identified as the highest priority DTC; and a diagnostic database in communication with the data retrieving device, the database listing possible vehicle defect solutions indexed to DTC's;

a digital signal processor separate from the vehicle ECU and disposable in communication with at least one of the data retrieving device and the diagnostic database and being operative to derive the highest priority DTC from analysis of the retrieved DTC's and the retrieved freeze frame data, and to regulate selection of a most likely vehicle defect solution associated with the vehicle identifying information and the highest priority DTC; and a repair parts database in operative communication with the diagnostic database and the digital signal processor, the repair parts database having repair parts associated the most likely vehicle defect solution, vehicle identification information and universal part numbers.

12. The automotive diagnostic system recited in claim 11, wherein the universal part numbers in the repair parts database are Aftermarket Catalog Enhanced Standard (ACES) part numbers.

13. The automotive diagnostic system recited in claim 11, further comprising an electronic parts catalog in communication with the repair parts database, the electronic parts catalog being searchable for the repair parts associated with the universal part number.

14. The automotive diagnostic system recited in claim 11, further comprising a transaction module in communication with the repair parts database and configured to generate a commercial transaction associated with the identified repair parts.

15. The automotive diagnostic system recited in claim 14, wherein the commercial transaction is associated with the purchase of the repair parts.

16. The automotive diagnostic system recited in claim 13, wherein the commercial transaction is associated with a repair service.

17. The automotive diagnostic system recited in claim 11, wherein the retrieved freeze frame data includes freeze frame data representative of the electrical signals that caused the highest priority DTC to be generated.

18. The automotive diagnostic system recited in claim 11, wherein the identification of the highest priority DTC is derivable from freeze frame data retrieved from the ECU.

19. A method of diagnosing vehicular defects with a data retrieving device comprising:

placing the data retrieving device in communication with a vehicle electronic control unit (ECU);

receiving vehicle identifying information and operational data including digital trouble codes (DTC's) and freeze frame data from the ECU;

deriving the highest priority DTC from analysis of the freeze frame data received from the ECU using a processor separate from the vehicle ECU;

identifying a most likely solution based on the vehicle identifying information and the highest priority DTC; and identifying a repair part associated with the most likely solution, the identified repair part being associated with a universal part number.

20. The method recited in claim 19, wherein the universal part number is an Aftermarket Catalog Enhanced Standard (ACES) part number.

21. The method recited in claim 19, wherein the step of identifying a repair part includes an assessment of the vehicle identification information.

22. The method recited in claim 19, further comprising the step of generating a sale of the repair part.

23. A diagnostic device comprising:

a connect/configure module for establishing a communication link between the diagnostic device and a vehicle electronic control unit (ECU);

a vehicle specification module operative to identify operating parameters of a vehicle under test in response to receipt of vehicle identifying information from the ECU;

a trouble code module for retrieving digital trouble codes (DTC's) from the ECU;

a database disposed within the diagnostic device, the database including a listing of possible vehicle defect solutions indexed to DTC's and the vehicle operating parameters;

a freeze frame data module for retrieving freeze frame data from the ECU, the retrieved freeze frame data being representative of the operation of a vehicle onboard device(s) associated with a DTC identified as the highest priority DTC; and a digital signal processor separate from the vehicle ECU in electrical communication with the vehicle specification module, the database, the trouble code module and the data module, the digital signal processor being operative to derive the highest priority retrieved DTC from analysis of the retrieved freeze frame data, and to regulate selection of a most likely vehicle defect solution associated with the vehicle operating parameters, and the highest priority retrieved DTC.

* * * * *